US009347726B1

(12) United States Patent
Thomas

(10) Patent No.: US 9,347,726 B1
(45) Date of Patent: May 24, 2016

(54) STRIKER STYLE FIREARM WITH IMPROVED MECHANICAL FUNCTION

(71) Applicant: Phillip Brady Thomas, Cocoa, FL (US)

(72) Inventor: Phillip Brady Thomas, Cocoa, FL (US)

( * ) Notice: Subject to any disclaimer, the term of this patent is extended or adjusted under 35 U.S.C. 154(b) by 0 days.

(21) Appl. No.: 14/716,560

(22) Filed: May 19, 2015

Related U.S. Application Data

(60) Provisional application No. 62/000,906, filed on May 20, 2014.

(51) Int. Cl.

| | |
|---|---|
| ***F41A 19/31*** | (2006.01) |
| ***F41A 19/13*** | (2006.01) |
| ***F41A 19/12*** | (2006.01) |
| ***F41A 3/02*** | (2006.01) |

(52) U.S. Cl.
CPC . *F41A 19/13* (2013.01); *F41A 3/02* (2013.01); *F41A 19/12* (2013.01)

(58) Field of Classification Search
CPC ..... F41A 19/13
USPC ..... 42/70.05, 70.04, 70.08, 69.01, 69.02; 89/136
See application file for complete search history.

(56) References Cited

U.S. PATENT DOCUMENTS

| | | | | |
|---|---|---|---|---|
| 1,537,369 | A | 5/1925 | Nicholson | |
| 3,435,728 | A | 4/1969 | Pachmayr et al. | |
| 4,893,546 | A | 1/1990 | Glock | |
| 5,259,138 | A * | 11/1993 | Scirica | F41A 17/72 42/70.08 |
| 5,502,914 | A | 4/1996 | Moon | |
| 5,741,996 | A | 4/1998 | Ruger et al. | |
| 6,553,706 | B1 | 4/2003 | Gancarz et al. | |
| 6,665,973 | B1 | 12/2003 | Peev | |
| 6,865,979 | B1 | 3/2005 | Vaid | |
| 7,337,571 | B2 | 3/2008 | McGarry | |
| 7,690,144 | B2 * | 4/2010 | Fagundes de Campos | F41A 17/72 42/69.02 |
| 7,810,268 | B1 | 10/2010 | McGarry | |
| 8,522,466 | B2 | 9/2013 | Arduini | |
| 2011/0219656 | A1 | 9/2011 | McGarry | |

FOREIGN PATENT DOCUMENTS

| | | |
|---|---|---|
| EP | 0846247 | 3/2004 |

* cited by examiner

*Primary Examiner* — Reginald Tillman, Jr.
(74) *Attorney, Agent, or Firm* — Brannen Law Office, LLC

(57) ABSTRACT

A firearm is provided according to the present invention. The firearm can be a striker style firearm having a slide. A trigger contacts a sear block at the front of the striker to fire the firearm. The striker then moves rearward with the slide under operation of the recoil spring and then returns forward. A reset plunger engages the striker during the second part of this process to reset the striker. The trigger has a release lever which is allowed to rotate relative to the rest of the trigger when the striker is reset and the sear block moves the release lever to the rotated position. The release lever rotates back to the ready position as the trigger is released. A slide stop is also provided that is held in place under operation of the recoil spring.

20 Claims, 9 Drawing Sheets

STRIKER STYLE FIREARM WITH IMPROVED MECHANICAL FUNCTION

This United States utility patent application claims priority on and the benefit of provisional application 62/000,906 filed May 20, 2014, the entire contents of which are hereby incorporated herein by reference.

BACKGROUND OF THE INVENTION

1. Field of the Invention

The present invention relates to striker style firearms with improved mechanical function, and in particular to improved trigger function relative to a striker, and well as slide stop function.

2. Description of the Related Art

There have been many firearms and many firearms improvements over the years. Some examples include:

U.S. Pat. No. 1,537,369 to Nicholson is titled Firearm.

U.S. Pat. No. 5,741,996 to Ruger et al. is titled Firearm Frame Including a Firearm Barrel and Trigger Mount Control Mechanism. It shows a firearm frame constructed of plastic material having slide rail guidance members in the forward, central and rear portions of the frame. The frame is useful with a barrel unit which is cammed back and down by slide reciprocation and by a cam block which with barrel movement being arrested by the walls of a frame cavity. Forces and energy created in arresting such back and down movement of the barrel and block is transferred to the frame by the block hitting the frame cavity. A slide stop pin passing through openings in the frame and cam block also assist in transferring energy to the frame. Forces causing the slide to move upward during the arresting of barrel and block is prevented buy the rail guidance members. The trigger rotates about a trigger trunnion located in such frame cavity below the cam block.

U.S. Pat. No. 6,665,973 to Peev is titled Striker Trigger Mechanism for Automatic and Semi-Automatic Firearms. It shows a mechanism that is applicable in military manufacture and is designed to be built in automatic and semi-automatic firearms of the kinds: pistols, machine guns and submachine guns. This mechanism is with simple construction and ensures enhanced over travel security for weapons, no safety, allowing for no accidental shooting to take place. The striker-trigger mechanism consists of a striker mechanism, a trigger mechanism and a fire-selecting mechanism integrated via a rear block. The fire selecting mechanism takes the form of a fire select. placed behind the breach block with an extractor, and an internal step-like channel centrally located, containing a firing pin with enlargements at both ends, front and rear one respectively. The firing pin has profile tooth protruding outside the breach block meant to engage with the trigger mechanism through a trigger equipped with a return spring and joint-lined to the frame. The trigger connects with a profile one-arm lever, made as trigger bar pushed to the breach block by spring. The trigger bar has an upper lug surface and a firing tooth to link with the striking mechanism. Between the two enlargements two axially movable spring cups are separated by the volute firing pin spring coiled around the firing pin.

U.S. Pat. No. 6,865,979 to Vaid is titled Apparatus and Method for Removing the Slide of a Semi-Automatic Pistol. It shows a method for removing the slide from a semi-automatic firearm is provided that includes the steps of: (1) providing an access port within the slide of the firearm that is positioned to align with the firing mechanism of the firearm; (2) inserting a probe into the access port; and (3) manipulating the firing mechanism with the probe, and thereby enabling the slide to be removed from the frame. A semi-automatic firearm is also provided that includes a frame, a slide removably mounted on the frame, a striker firing-pin mounted within the slide, a firing mechanism, and an access port disposed in the slide. When the slide is in a predetermined position, the firing mechanism can be accessed through the access port with a probe and manipulated to allow removal of the slide from the frame.

U.S. Pat. No. 7,337,571 to McGarry is titled Slide Stop Latch for a Firearm. It shows a camblock assembly with a camblock and a guide rod is employed in a firearm having a frame constructed of synthetic polymer material. The camblock has a front flange with flange surfaces that engage corresponding bearing surfaces of the frame to distribute forces and energy to the frame during recoil of the firearm. A shelf member is positioned at a front end of the camblock and a coiled flat wire buffer spring is positioned about the guide rod to resist movement of a reciprocating slide. A detent mechanism positioned within the camblock contacts a surface of a slide stop pin to hold the slide stop latch in place. The interior of the slide stop latch contains an elongated wire having an end that engages the frame such that the slide stop latch is biased in a down position.

U.S. Pat. No. 8,522,446 to Arduini is titled Low-Force Rolling Trigger. It shows, in an embodiment, a low-force, low-friction, short-travel, low-energy control rolling trigger utilizes a rolling element as a trigger-release mechanism in equipment, machines and tools such as for clutches, brakes, actuators, and projectile launchers. The rolling elements within the trigger mechanism reduce the friction, which in-turn reduces the force necessary to discharge trigger. In an embodiment, the trigger is part of a firearm and uses a mechanical trigger. In another embodiment, the trigger is activated by an electronic signal that activates a solenoid, which pulls the rolling element, and thereby releases the striker or in a trigger-release assembly.

While the embodiments described in each of these patents may work well for their intended purposes, they each can be improved upon.

None show a trigger assembly with the elimination of a trigger bar.

None show a release lever of a trigger releasing the striker in the front of the striker by disengaging a sear block.

None show a recoil spring holding down a slide stop therefore eliminating a spring.

Thus there exists a need for striker style firearm with improved mechanical function that solves these and other problems.

SUMMARY OF THE INVENTION

A firearm is provided according to the present invention. The firearm can be a striker style firearm having a slide. A trigger contacts a sear block at the front of the striker to fire the firearm. The striker then moves rearward with the slide under operation of the recoil spring and then returns forward. A reset plunger engages the striker during the second part of this process to reset the striker. The trigger has a release lever which is allowed to rotate relative to the rest of the trigger when the striker is reset and the sear block moves the release lever to the rotated position. The release lever rotates back to the ready position as the trigger is released. A slide stop is also provided that is held in place under operation of the recoil spring.

According to one advantage of the present invention, a trigger bar (or transfer element) is eliminated. This advantageously provides many advantages. One such advantage is the reduction of parts, and in particular the reduction of moving parts.

Related, the trigger contacts a sear block directly to release the striker. Tolerances may be reduced as intermediate components between the trigger and striker are eliminated. The sear block releases the striker at the front of the striker due to the compact nature of the design.

According to a further advantage of the present invention, the firearm can be field stripped while the trigger is in place. This advantageously results in faster field stripping, easier disassembly and cleaning and the elimination of the need to readjust the trigger after reassembly. Further, safety of the firearm is enhanced because the trigger is not engaged and the striker is not fired during the field stripping of the present invention (which is required in other models and which can lead to an unintended firing if a round is live in the chamber).

According to a still further advantage of the present invention, elimination of the trigger bar, which would traditionally interfere with the use of a strong sear block spring, is eliminated. Accordingly, a relatively strong sear block spring can be used which enhances the safety of the device. The overall trigger pull force is a function of both the trigger spring and the sear block spring. The amount of trigger pull therefore required for firing of the firearm can be tuned or selected.

According to a still further advantage yet of the present invention, a release lever is provided and is rotatably connected to the trigger. The release lever rotates or toggles out of the way as the striker returns to ready position and the sear block contacts the release lever. Accordingly, the reset lever allows the striker to be ready to release again even before the user releases the trigger from the immediately preceding firing.

Related, and according to a still further advantage yet of the present invention, the reset lever automatically resets when the trigger is released under operation of a reset lever spring.

According to a still further advantage of the present invention, a reset plunger is provided for contacting the striker to reset the striker to the ready position.

According to a still further advantage yet of the present invention, the slide stop (or slide stop release) is held in position under force of the recoil spring. This is accomplished with the use of a slide stop plunger operably connected to the recoil spring and eliminates the need for additional springs to be required for operation.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
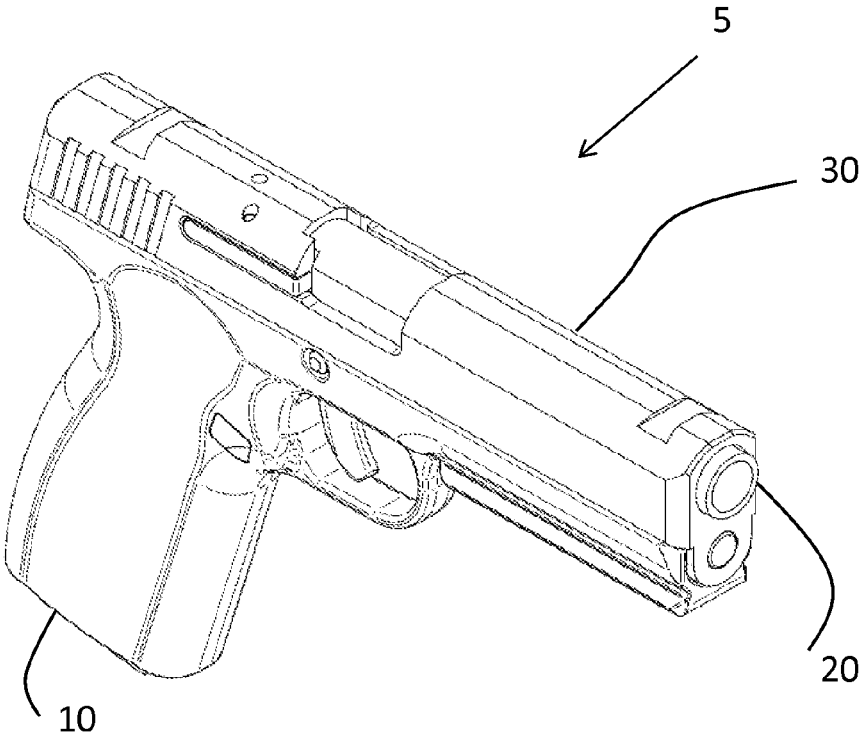
FIG. 1 is a perspective view of a preferred embodiment of the present invention.
Figure 2:
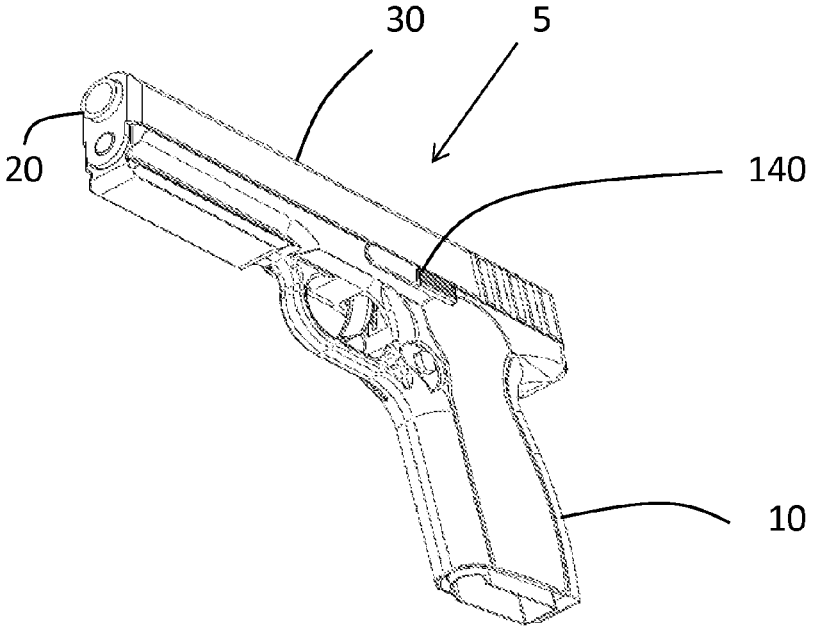
FIG. 2 is a reverse view of the embodiment illustrated in FIG. 1.
Figure 3:
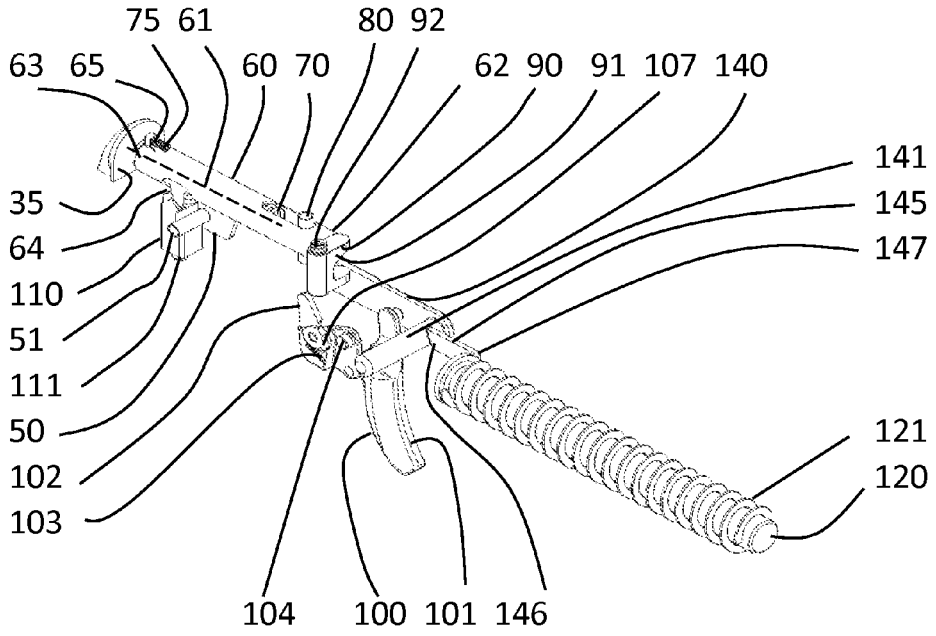
FIG. 3 is a perspective view of isolated parts of the preferred embodiment of the present invention.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-7A, it is seen that a first preferred embodiment of the firearm 5 of present invention, is illustrated.

The firearm 5 has a grip 10 and a barrel 20. A slide 30 with a slide rear cover 35 is also provided. The slide 30 is movable relative the barrel 20 during operation of the firearm. The slide 30 has an exterior and an interior region 31.

Figure 7:
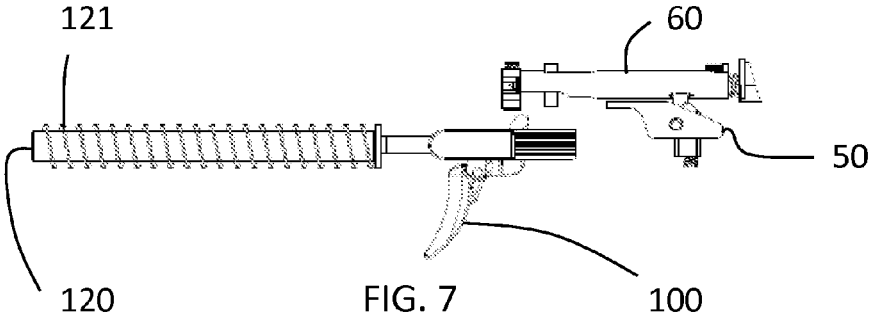
FIG. 7 is a reverse side view of the isolated parts of the embodiment illustrated in FIG. 3.
Figure 7A:
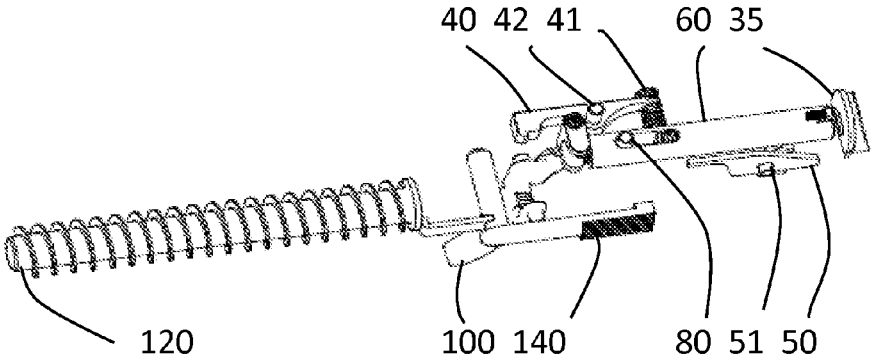
FIG. 7A is a view similar to FIG. 3, but shows the extractor as well.

An extractor 40 is provided with an extractor spring 41 and an extractor pin 42 as seen on FIG. 7A. An ejector 50 operable about an ejector pin 51 is also provided. The extractor 40 and the ejector 50 work together to remove spent casings from the firearm.

A striker 60 operable along an axis 61 is further provided. The striker 60 has a front end 62 and an opposed rear or back end 63. A lug 64 and a tab 65 are further provided. The lug 64 is on the bottom of the striker. The tab 65 is on the top of the striker at the back end 63. A striker spring 70 is contained within the striker. A return spring 75 is further provided and is operable against tab 65. A vertical pin 80 is provided from limiting the travel of the striker 60 relative to the slide 30. In this regard, during operation, the striker can move along axis 61 within the interior region 31 of the slide 30 depending on inertial and spring forces.

A sear block 90 is further provided. The sear block 90 has a release profile 91 and a sear block spring 92. The release profile is generally semicircular or C-shaped. Yet, it is understood that other profiles may be used without departing from the broad aspects of the present invention. The sear block profile 91 has a top and a bottom. The top preferably contacts the top front edge of the striker 60 to hold the striker in the ready to fire position. Disengagement of the sear block 90 and striker 60 causes the striker to move forward and fire the firearm 5. The sear block spring vertically biases the sear block in a downward orientation.

Figure 4:
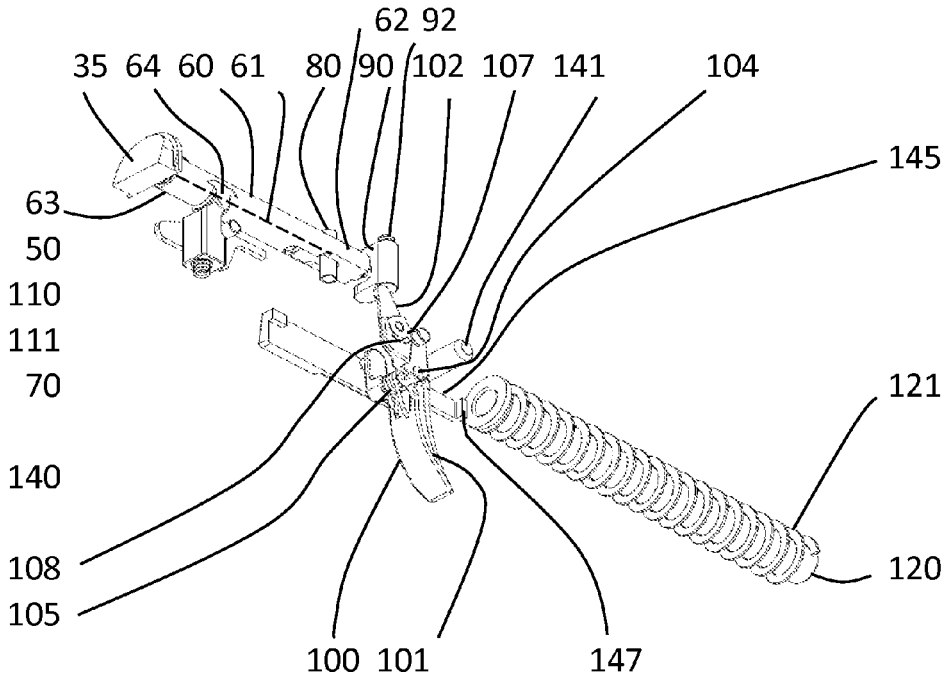
FIG. 4 is a reverse perspective view of the isolated parts of the embodiment illustrated in FIG. 3.
Figure 4A:
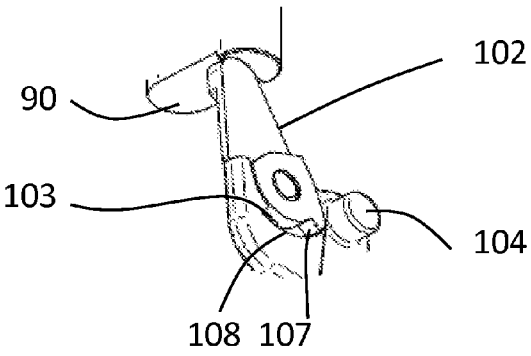
FIG. 4A is a close-up view showing the trigger release lever.
Figure 5:
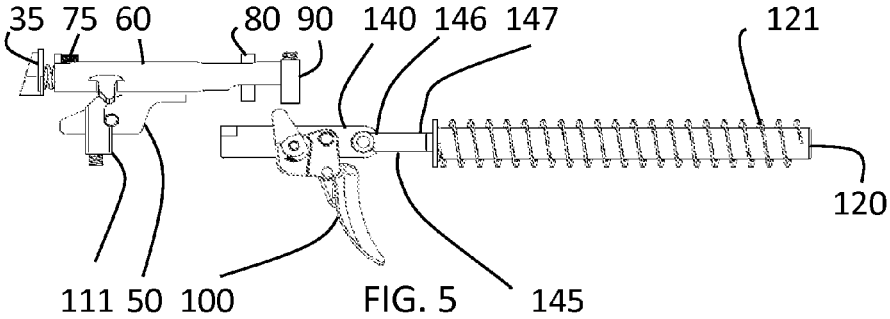
FIG. 5 is a side view of the isolated parts of the embodiment illustrated in FIG. 3.
Figure 6:
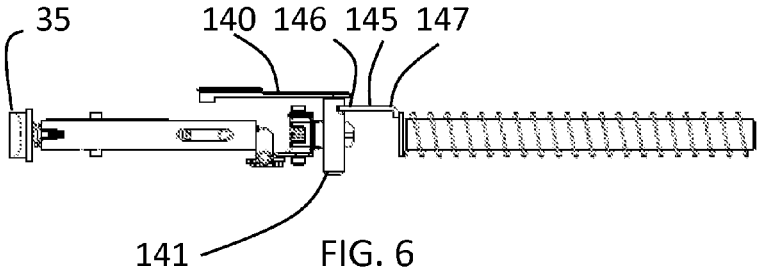
FIG. 6 is a top view of the isolated parts of the embodiment illustrated in FIG. 3.

A trigger 100 is further provided. The trigger 100 has a body 101 (or main body) and a release lever 102. The release lever 102 is pivotally connected to the main body 101 and is biased towards a first upstanding position with a release lever spring 103. The lever 102 has a lever tab 107 that limits the rotational travel of the release lever relative to a recessed area 108 about a portion of the perimeter of the trigger body 101. The recessed area 108 has a depth sufficient to accommodate the tab 107 and two ends that limit the rotational travel of the lever 102 relative to the body 101. The trigger is rotatable about a trigger pin 104 and is biased towards a first position with a trigger spring 105. Upon pulling of the trigger 100, the tab 107 is at one end of the travel range or recess end so that the release lever 102 is forced to rotate with the trigger body 102 about the trigger pin in the first direction. Hence, the release lever has a vertical component (vertical component of the rotation) of motion which causes the release lever to contact and force the sear block 90 to rise vertically overcoming the spring 92 of the sear block 90. A close-up view of the trigger release lever is illustrated in FIG. 4A.

A reset plunger 110 is also provided. The reset plunger 110 is held within a pocket and is biased vertically upwards from the base of the pocket with a reset plunger spring 111. The reset plunger 110 is depressed by the striker when resetting. It is also depressed by the striker when the slide is moving rearward after the firearm is fired. The reset plunger 110 is further depressed by the bottom of the slide when the slide is moved back far enough. As an alternative embodiment, the reset mechanism could alternatively be a rotatable component or a flexible component instead of a plunger without departing from the broad aspects of the present invention.

A recoil rod 120 and recoil spring 121 are further provided. The recoil spring has a first end and a second end.

A magazine catch 130 and magazine catch spring 131 are provided for supporting a magazine 132.

Figure 15:
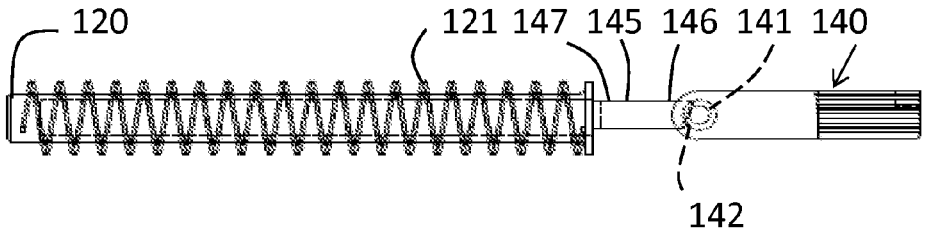
FIG. 15 is an isolation view of a slide stop in a first position.
Figure 16:
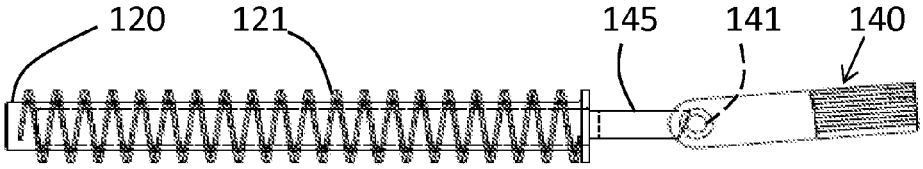
FIG. 16 is similar to FIG. 15, but shows the slide stop in a second (raised) position.
Figure 17:
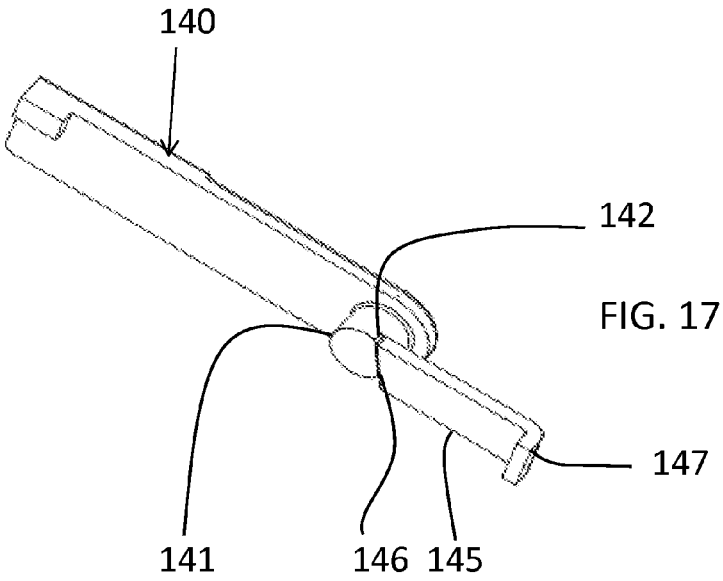
FIG. 17 is a cross-sectional view showing the slide stop plunger engaging the slide stop.

A slide stop 140 is further provided, and is seen in FIGS. 15-17. The slide stop has a shaft 141 and is rotatable thereabout. The shaft 141 has a tab 142. The tab 142 is preferably angularly oriented (that is, between being parallel to and perpendicular to the axis 61 of the striker). A slide stop plunger 145 is further provided having ends 146 and 147. End 146 of the slide stop plunger 145 is also angularly oriented so that is can matingly slide against or relative to the tab 142 of the slide stop shaft 141. End 147 engages the recoil spring 121 wherein the spring force of the recoil spring 121 biases the slide stop plunger 145 to hold the slide stop down. The force of the recoil spring 121 provides sufficient lateral force that the angled mating engagement of the tab 142 and end 147 keeps the slide stop in a down position.

When the last round is fired, the slide stop is forced up by the magazine and prevents the slide from returning. This occurs because the recoil spring force is overcome therefore allowing the slide stop to rise to the up position whereby it contacts the slide. This alerts the user that a new magazine must be inserted in order to fire any more rounds. The slide stop can be pulled down about the shaft to allow the slide to return past the slide stop. Other means of moving the slide may also be used.

Figure 18:
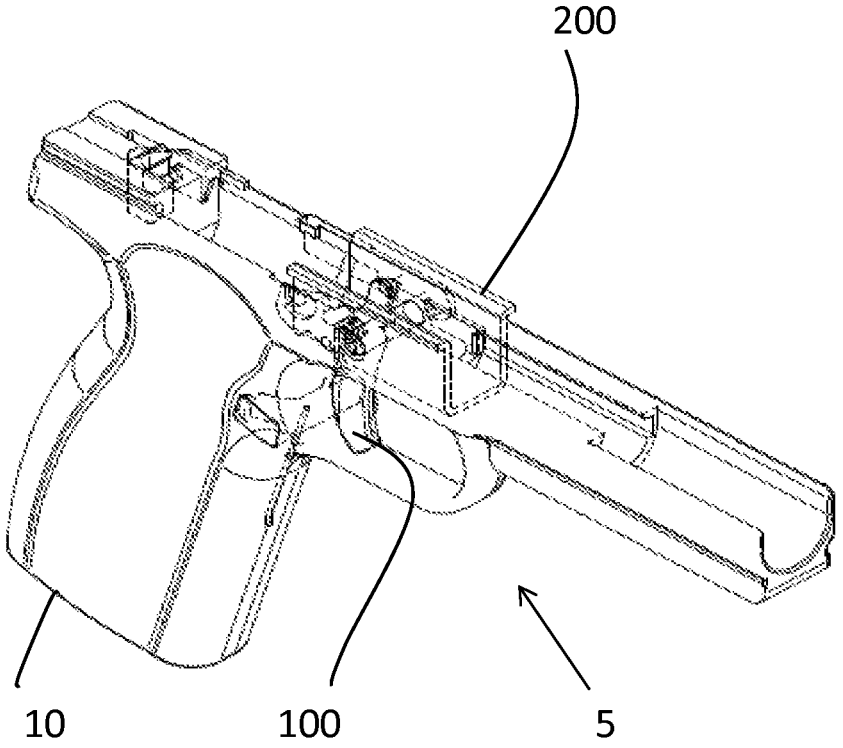
FIG. 18 is a perspective view showing a trigger housing.

Turning now to FIG. 18, a casing 200 is provided. The casing 200 houses the trigger assembly and is fastened (by pin, bolt or other fastening mechanism) to the frame so that the entire assembly can be easily removed.

Turning now to FIGS. 8-14, it is seen that operation of the trigger is illustrated.

Figure 8:
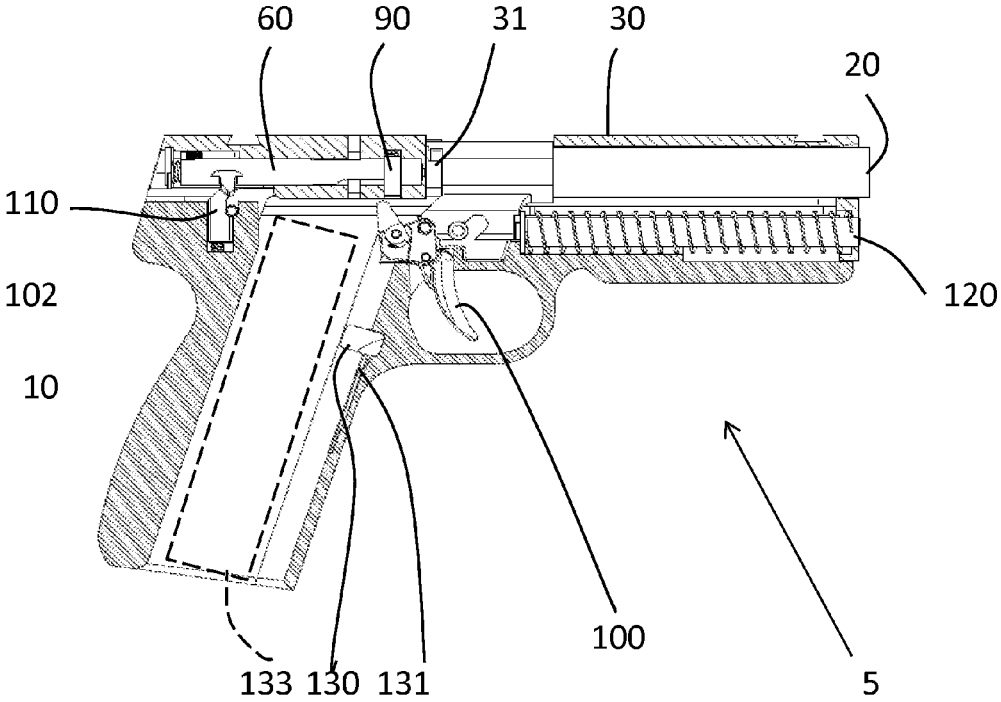
FIG. 8 is a cross-sectional view taken along line 8-8 in FIG. 1 showing the firearm in the ready to fire position.

The firearm 5 is shown in the ready to fire position in FIG. 8. In the preferred embodiment, the trigger pull force necessary to fire the firearm is about 7 pounds. About five pounds can be attributed to the trigger spring 105 and about two pounds can be attributed to the sear block spring 92. Of course, these amounts can be greater or smaller without departing from the broad aspects of the present invention.

Figure 9:
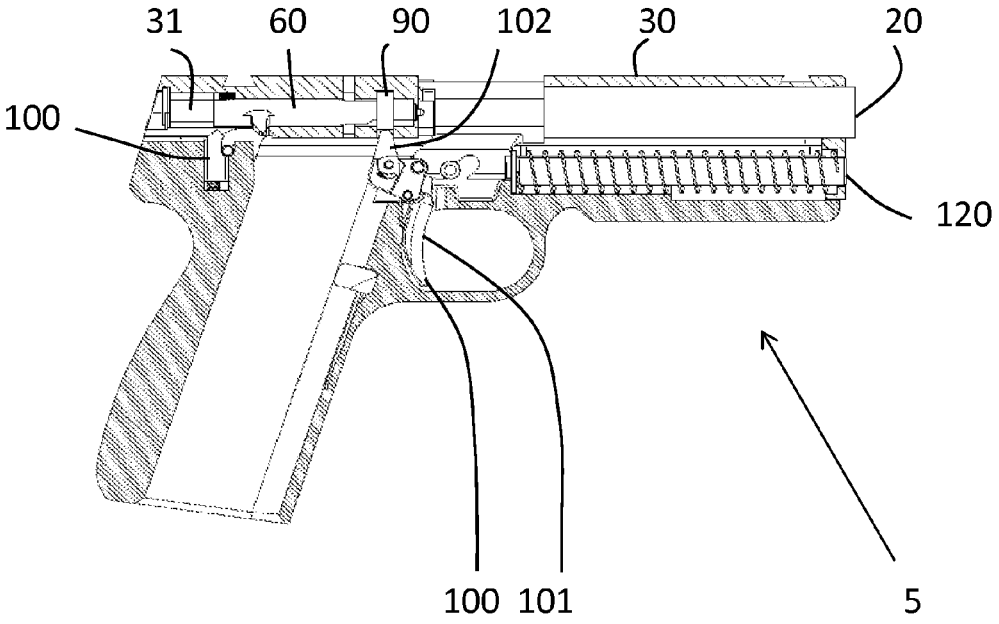
FIG. 9 is similar to FIG. 8, but shows the firearm in the fired position.

FIG. 9 shows the firearm in the fired position. It is seen that the release lever 102 has forced the sear block to move upwards as the trigger was rotated about the trigger pin 104. This allows the striker 60 to be released as the striker 60 is no longer constrained by the sear block 90.

Figure 10:
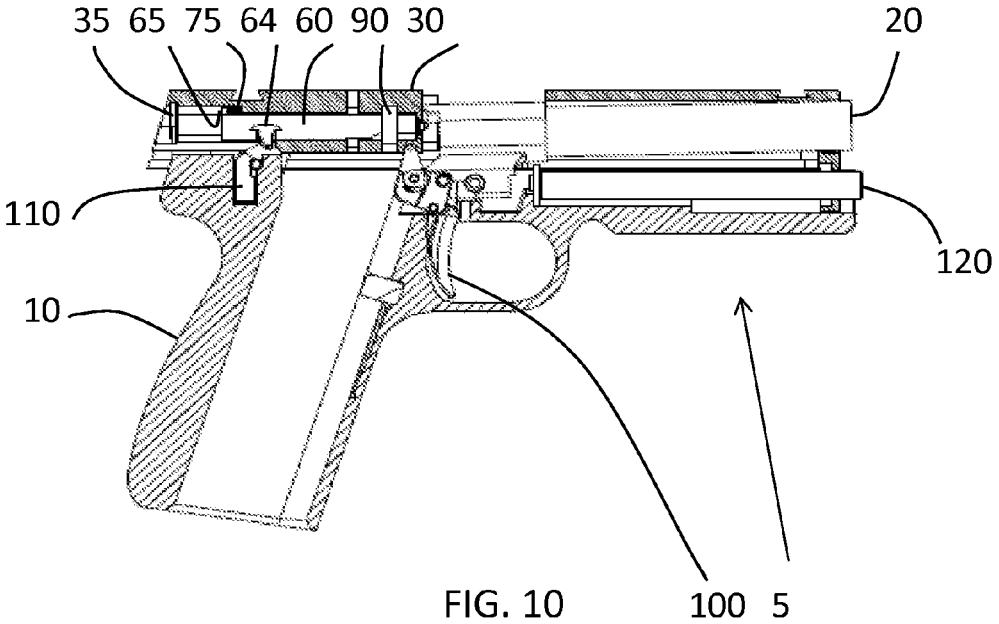
FIG. 10 is similar to FIG. 8, but shows the firearm slide in the unlocked position.

FIG. 10 shows the slide unlocked and the striker and slide can moving rearward.

Figure 11:
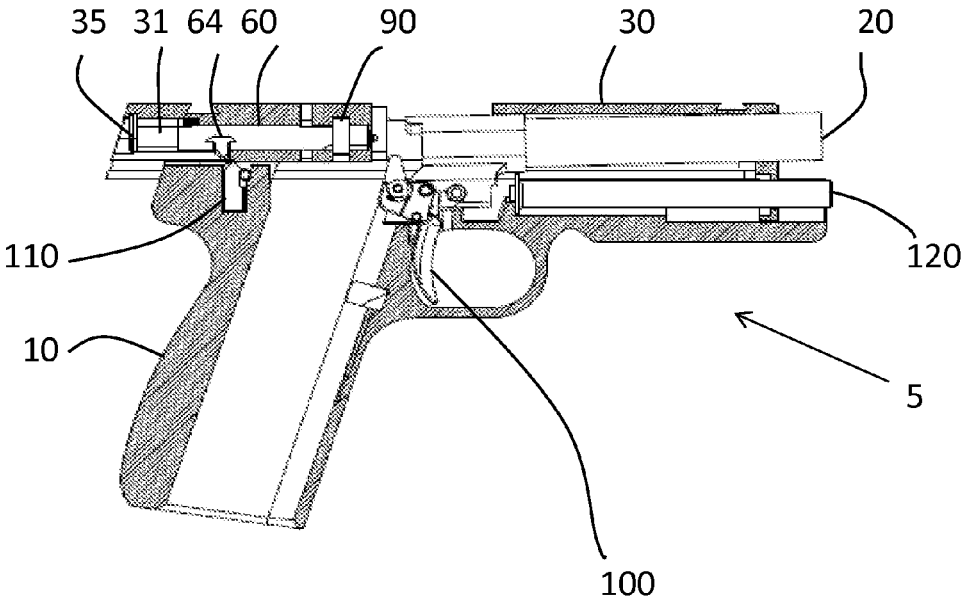
FIG. 11 is similar to FIG. 8, but shows the firearm with the firing pin depressing the plunger as the slide moves rearward.

FIG. 11 shows the slide depressing the reset plunger during rearward motion of the slide.

Figure 12:
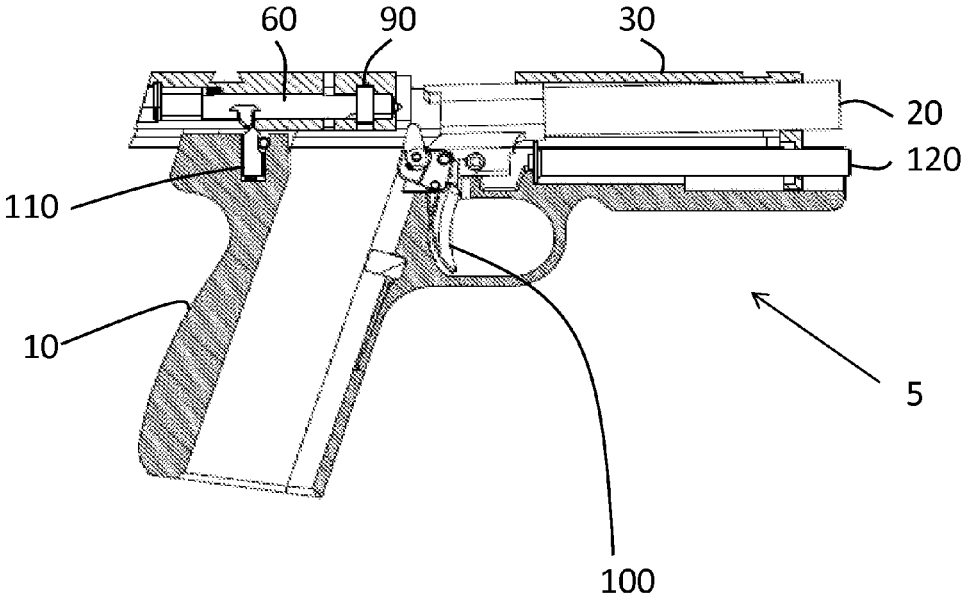
FIG. 12 is similar to FIG. 8, but shows the firearm with the slide returning and the plunger engaging the striker.

FIG. 12 shows the slide 30 returning forward and the reset plunger 110 engaging the lug 64 on the bottom of the striker to hold the striker in place. Return spring 75 is shown fully compressed in this view.

Figure 13:
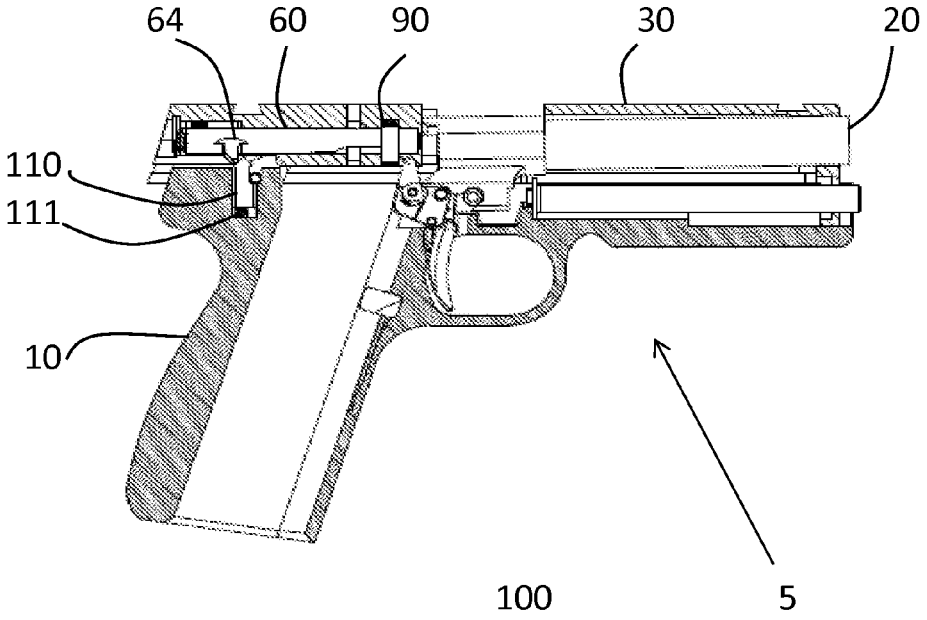
FIG. 13 is similar to FIG. 8, but shows the firearm with the slide returning to battery and the sear block reset.

FIG. 13 shows the slide 30 moving forward to return towards battery and the reset plunger 110 maintaining contact with the lug 64.

Figure 14:
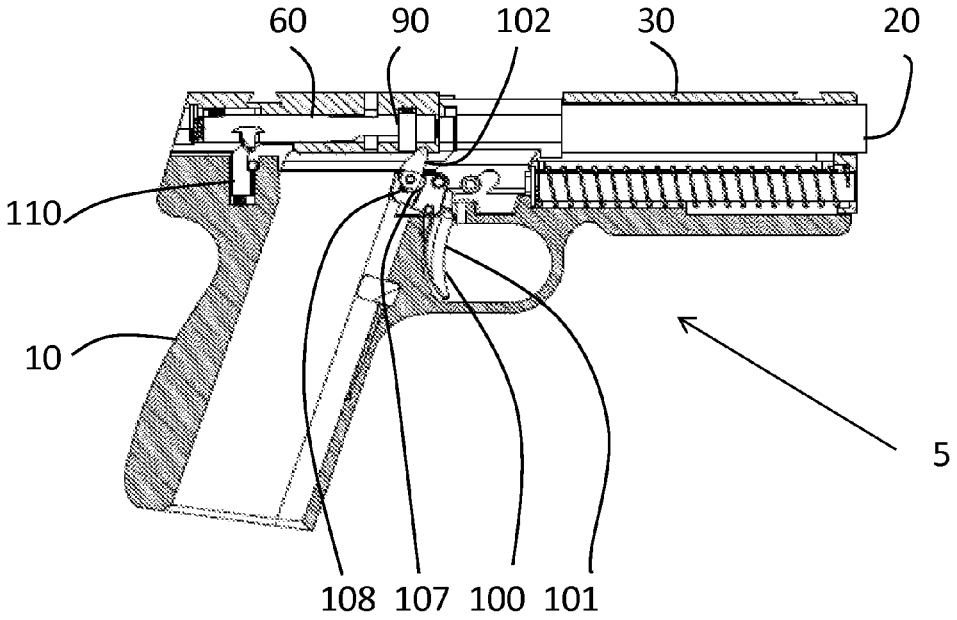
FIG. 14 is similar to FIG. 8, but shows the firearm with the slide returned to battery and the release lever rotated.

FIG. 14 shows the slide returned to battery, the sear block 90 again engaging the striker 60 and the release lever 102 being rotated by the sear block relative to the trigger body 101. The release lever 102 can rotate in this direction relative to the trigger body 101 since the tab 107 is not restricting the rotation in this direction (due to recess area 108) when the force of the sear block (lateral movement of sear block) overcomes the bias force of the release lever spring 103. The trigger is released and the release lever is allowed to return to its normal biased position under biasing spring force of spring 103 when the trigger is released.

A sufficient force is developed internally at the end of the return stroke to force the striker forward and overcome the reset plunger spring force that is maintaining the upward position of the reset plunger.

The release lever 102 returns to its normal position relative to the trigger body 101 under operation of the release lever spring 103 once the trigger 100 is released by the user.

It is appreciated that in an alternative embodiment, that a two piece sear block and a single integral trigger could alternatively be used without departing from the broad aspects of the present invention.

It is further appreciated that is a further alternative embodiment, that if sufficient inertia is developed by the slide slamming rearward, then the striker can continue on and overcome the striker spring and reset the sear block.

Thus it is apparent that there has been provided, in accordance with the invention, striker style firearms with improved mechanical function that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A firearm having a ready to fire position and a fired position, said firearm comprising:

a barrel;

a slide, said slide being in battery when said firearm is in the ready to fire position;

a striker, said striker having a striker front end;

a trigger comprising a body and a release lever, said release lever rotating about a pivot along with said body when said trigger is engaged by a user to initiate firing of said firearm; and a sear block, said sear block engaging said striker approximately at said striker front end when said firearm is in the ready to fire position, wherein said release lever of said trigger causes said sear block to release said striker when said body of said trigger is engaged by the user to initiate firing of said firearm.

2. The firearm of claim 1 wherein:

after said firearm is fired, said slide leaves from and returns to battery, said release lever is rotatable relative to said body from a first position to a second position, and rotates relative to said body when contacted by said sear block.

3. The firearm of claim 2 wherein said slide is capable of returning to battery before the user releases the trigger.

4. The firearm of claim 2 wherein said trigger further comprises a release lever spring, said release lever spring biasing said release lever to said first position.

5. The firearm of claim 1 wherein:

said sear block moves in a sear block plane that is generally perpendicular to a barrel axis; and said release lever contacts said sear block and causes said sear block to move in said sear block plane.

6. The firearm of claim 1 further comprising a reset plunger.

7. The firearm of claim 1 further comprising a vertical pin extending through said striker.

8. The firearm of claim 1 wherein said sear block is generally semi-circular.

9. The firearm of claim 1 further comprising a slide stop release that that is held in place under a force of a recoil spring.

10. A firearm having a ready to fire position and comprising:

a barrel;

a slide, said slide being in battery when said firearm is in the ready to fire position;

a striker;

a trigger having a trigger body and a release lever, said release lever having a first position and a second position, said trigger being capable of being pulled; and a sear block, wherein:

said trigger causes said sear block to release said striker when said release lever is in said first position when said trigger is pulled; and said sear block causes said release lever to rotate relative to said trigger body to said second position when said slide is returning to battery.

11. The firearm of claim 10 wherein said trigger further comprises a release lever spring to bias said release lever towards said first position.

12. The firearm of claim 10 wherein:

said barrel has a barrel axis;

said sear block moves in a sear block plane that is generally perpendicular to said barrel axis; and said release lever contacts said sear block and causes said sear block to move in said sear block plane.

13. The firearm of claim 10 wherein a user must release said trigger between successive firings of said firearm, and said slide is capable of returning to battery before the user releases the trigger.

14. The firearm of claim 10 further comprising a reset plunger.

15. The firearm of claim 10 wherein:

said body of said trigger is movable in a first rotational direction while being pulled by a user;

said release lever of said trigger is movable in a second rotational direction when said release lever moves from said first position to said second position; and said first rotational direction is the same as said second rotational direction.

16. The firearm of claim 10 further comprising a slide stop release that that is held in place under a force of a recoil spring.

17. A firearm having a ready to fire position and a fired position, said firearm comprising:

a barrel;

a slide, said slide being in battery when said firearm is in the ready to fire position;

a striker;

a trigger, said trigger being engaged by a user to initiate firing of said firearm; and a sear block, said sear block engaging said striker when said firearm is in the ready to fire position, wherein said trigger causes said sear block to release said striker when said trigger is engaged by the user to initiate firing of said firearm;

wherein said trigger comprises:

a body; and a release lever; and wherein:

after said firearm is fired, said slide leaves from and returns to battery, said release lever is rotatable relative to said body from a first position to a second position, and rotates relative to said body when contacted by said sear block.

18. A firearm having a ready to fire position and a fired position, said firearm comprising:

a barrel;

a slide, said slide being in battery when said firearm is in the ready to fire position;

a striker;

a trigger, said trigger being engaged by a user to initiate firing of said firearm; and a sear block, said sear block engaging said striker when said firearm is in the ready to fire position, wherein said trigger causes said sear block to release said striker when said trigger is engaged by the user to initiate firing of said firearm;

wherein said trigger comprises:

a body; and a release lever; and wherein:

said sear block moves in a sear block plane that is generally perpendicular to a barrel axis; and said release lever contacts said sear block and causes said sear block to move in said sear block plane.

19. A firearm having a ready to fire position and a fired position, said firearm comprising:

a barrel;

a slide, said slide being in battery when said firearm is in the ready to fire position;

a striker;

a trigger, said trigger being engaged by a user to initiate firing of said firearm;

a sear block, said sear block engaging said striker when said firearm is in the ready to fire position; and a vertical pin extending through said striker, wherein said trigger causes said sear block to release said striker when said trigger is engaged by the user to initiate firing of said firearm.

20. A firearm having a ready to fire position and a fired position, said firearm comprising:

a barrel;

a slide, said slide being in battery when said firearm is in the ready to fire position;

a striker;

a trigger, said trigger being engaged by a user to initiate firing of said firearm;

a sear block, said sear block engaging said striker when said firearm is in the ready to fire position; and a slide stop release that that is held in place under a force of a recoil spring, wherein said trigger causes said sear block to release said striker when said trigger is engaged by the user to initiate firing of said firearm.

* * * * *